US011740010B2

(12) United States Patent
Akalan et al.

(10) Patent No.: US 11,740,010 B2
(45) Date of Patent: Aug. 29, 2023

(54) HOUSEHOLD APPLIANCE

(71) Applicant: BSH Hausgeraete GmbH, Munich (DE)

(72) Inventors: Yigit Akalan, Tekirdag (TR); Orkun Mert Ergin, Tekirdag (TR); Samuel Harward, Knoxville, TN (US); Cemalettin Hasturk, Knoxville, TN (US); Toygun Karakaya, Tekirdag (TR); Erhan Kaya, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 17/533,363

(22) Filed: Nov. 23, 2021

(65) Prior Publication Data

US 2022/0205710 A1 Jun. 30, 2022

(30) Foreign Application Priority Data

Dec. 30, 2020 (TR) ..... 2020/22338

(51) Int. Cl.
*F25D 23/06* (2006.01)

(52) U.S. Cl.
CPC ..... *F25D 23/066* (2013.01)

(58) Field of Classification Search
CPC ..... F25D 23/066; F25D 23/082; F25D 23/085
See application file for complete search history.

(56) References Cited

U.S. PATENT DOCUMENTS

| | | | | |
|---|---|---|---|---|
| 2,708,529 A | | 5/1955 | Lander et al. | |
| 2,855,636 A | | 10/1958 | Donnelly | |
| 2,873,041 A | * | 2/1959 | Allen | F25D 23/085 220/592.06 |
| 4,732,432 A | * | 3/1988 | Keil | F25D 23/082 220/592.06 |
| 10,808,989 B2 | | 10/2020 | Yoon et al. | |
| 10,914,514 B1 | * | 2/2021 | Hunter | F25D 23/066 |
| 11,340,008 B1 | * | 5/2022 | Hunter | F25D 21/04 |
| 2018/0142938 A1 | | 5/2018 | Ciyanoglu et al. | |
| 2021/0404734 A1 | * | 12/2021 | Akalan | F25D 23/066 |

FOREIGN PATENT DOCUMENTS

| | | |
|---|---|---|
| EP | 3327378 A1 | 5/2018 |
| EP | 3339781 A1 | 6/2018 |
| GB | 712226 A | 7/1954 |

* cited by examiner

*Primary Examiner* — Daniel J Rohrhoff
(74) *Attorney, Agent, or Firm* — Laurence A. Greenberg; Werner H. Stemer; Ralph E. Locher

(57) ABSTRACT

A household appliance includes at least one compartment and a housing connection arrangement which surrounds the compartment and includes an outer liner facing outside, an inner liner spaced apart from the outer liner, and a housing frame connected to the outer liner from one side and to the inner liner facing the compartment from the other side. At least one elastic member is provided on a region of the housing connection arrangement where the housing frame connects to the outer liner. At least one reinforcement member is provided adjacent to the outer liner, the housing frame and the elastic member. The reinforcement member includes a first connection lug which is at least partially received by a portion of the elastic member from one side, and a second connection lug configured to be connected to the outer liner with a connection member, from the other side.

13 Claims, 6 Drawing Sheets

HOUSEHOLD APPLIANCE

CROSS-REFERENCE TO RELATED APPLICATION

This application claims the priority, under 35 U.S.C. § 119, of Turkish Patent Application TR 2020/22338, filed Dec. 30, 2020; the prior application is herewith incorporated by reference in its entirety.

FIELD AND BACKGROUND OF THE INVENTION

The present invention relates to a household appliance, especially a cooling device, having at least one compartment and a housing connection arrangement surrounding the compartment and including:

- an outer liner facing outside,
- an inner liner spaced apart from the outer liner
- a housing frame connected to the outer liner from one side and to the inner liner facing the compartment from the other side,
- at least one elastic member provided on a region of the housing connection arrangement where the housing frame connects to the outer liner, and
- at least one reinforcement member provided adjacent to the outer liner, the housing frame and the elastic member.

PRIOR ART

Household appliances, preferably cooling appliances, are provided with a housing which includes, in particular, an inner liner and an outer liner. The inner liner delimits in particular a storage space of the household appliance device. The storage space is in particular a space inside the household appliance device, which is provided for storing food. The outer liner delimits the household appliance device relative to the environment.

Furthermore, the housing includes a housing frame on which, in a closed state of a household appliance door, the household appliance door of the household appliance device may rest in a flat position. In particular, the housing frame may preferably be directly connected to the inner liner and/or the outer liner.

The housing includes in particular an outer liner. The outer liner is in particular configured for reducing heat transfer between the inner liner and the outer liner. The outer liner connects the housing frame to the outer liner.

In particular, the inner liner, the outer liner, the housing frame and/or the outer liner together define the insulation space. The insulation space is in particular configured for reducing heat transfer from the environment of the household appliance device to the storage space of the household appliance device.

European Patent Application EP 3 327 378 A1, corresponding to U.S. Patent Application No. 2018/0142938, discloses a side element connecting the housing frame to the outer liner. For the purpose of improving the efficiency of a household appliance device, in particular a household chiller appliance device, it is proposed to include a housing delimiting an insulation space, a heating unit disposed inside the insulation space, and a heat transfer element disposed inside the insulation space, the heat transfer element at least partly contacting the heating unit and at least partly contacting the housing for transferring heat from the heating unit to the housing.

SUMMARY OF THE INVENTION

The present invention proposes to provide an additional improvement, an additional advantage or an alternative to the prior art.

It is accordingly an object of the invention to provide a household appliance and a method of assembling housing parts of the household appliance, which overcome the hereinafore-mentioned disadvantages of the heretofore-known appliances and methods of this general type and which provide a safe and rigid assembly of the housing of an appliance or cooling device.

With the foregoing and other objects in view there is provided, in accordance with the invention, a household appliance having at least one compartment and a housing connection arrangement surrounding the compartment including: an outer liner facing outside, an inner liner spaced apart from the outer liner, a housing frame connected to the outer liner from one side and to the inner liner facing the compartment from the other side, at least one elastic member provided on a region of the housing connection arrangement where the housing frame connects to the outer liner, and at least one reinforcement member provided adjacent to the outer liner, the housing frame and the elastic member. As an improvement, the reinforcement member includes a first connection lug which is at least partially received by a portion of the elastic member, from one side, and a second connection lug configured to be connected to the outer liner with a connection member, from the other side. Thus, rigidity of the household appliance is increased at the housing since the reinforcement member is prevented from dropping.

In this case, the household appliance can be a cooling, a cooking or a washing device. In the present invention, the appliance is a cooling device, especially a refrigerator.

In this case, the connection element can be any kind of member, which provides a connection of at least two parts, i.e. a rivet, a screw, or a bolt.

In another possible embodiment of the invention, the connection hole is provided on the reinforcement member for assembling the outer liner to the reinforcement member with a rivet connection which is applied from outside of the appliance. Thus, practical and safer mounting can be achieved during assembly of the appliance. In this case, the connection hole can be any kind of hole through which i.e. a rivet, a screw, or a bolt can pass. The shape and size of the connection hole(s) can vary according to the type and size of the connection element.

In a further possible embodiment of the invention, the elastic member is made from thermoplastic material. Thus, the elasticity of the system is increased for additional increased durability of the housing arrangement connection.

In an added possible embodiment of the invention, the reinforcement member is made of steel material. Thus, rigidity of the appliance is increased. In this case, the steel material can be any type of steel, such as a stainless steel.

In an additional possible embodiment of the invention, the elastic member has a receiving channel which at least partially receives the first connection lug in a loose manner. Thus, good alignment and easy placement for the assembly can be provided.

In another possible embodiment of the invention, the channel has a monolithic or one-piece structure with the elastic member. Thus, the channel is produced during the manufacture of the elastic member. This provides low cost production advantages.

In a further possible embodiment of the invention, the reinforcement member has at least one cutout to provide a free area for insulation material to be filled in. Thus, the thermal insulation of the appliance is increased. In this case, the insulation material may be any kind of material, such as a polyurethane that provides insulation between the compartment and outside of the cooling appliance.

In an added possible embodiment of the invention, a bent part or bending is provided which extends from the reinforcement member towards the housing frame in order to be filled with insulation material. Thus, the insulation material can be filled in easily to provide heat insulation.

In an additional possible embodiment of the invention, the second connection lug has a connection hole for assembling the household appliance. Thus, assembly to the household appliance can be provided with any connection element by combining parts with these connection holes.

In another possible embodiment of the invention, the first and second connection lugs extend basically parallel to each other. Thus, easy alignment can be provided during the mounting process.

In a further possible embodiment of the invention, the first and second connection lugs are provided so as to extend in the direction opposite to each other. Thus, a combination with both the elastic member and the outer liner can be achieved.

In an added possible embodiment of the invention, the reinforcement member is combined with the elastic member by shrink fitting. Thus, easy and practical assembly can be achieved by an operator.

In an additional possible embodiment of the invention, the first and second connection lugs have a monolithic or one-piece structure with the reinforcement member. Thus, a fixation of parts is provided without requiring extra material for attaching or gluing, etc. This also increases the durability of the reinforcement member.

In another possible embodiment of the invention, the household or home appliance is a cooling device, especially a refrigerator.

With the objects of the invention in view, there is concomitantly provided a method of assembling housing parts of the household appliance, including the steps of: assembling the elastic member with the housing frame by inserting the housing frame into the channel provided on one side of the elastic member, assembling the reinforcement member with the elastic member by inserting the first connection lug of the reinforcement member into the channel provided on the opposite side of the elastic member, assembling the outer liner with the reinforcement member by using the connection hole on the second connection lug applied from outside of the appliance. Thus, practical and safe assembly of the housing parts of the household appliance is provided.

In this context, the terms "top," "bottom," "front," "rear," "horizontal," "vertical," "upward," "downward," "inner," "outer," "inward," "outward," etc. indicate the positions and orientations given for intended use and intended arrangement of the cooling device and for a user then standing in front of the cooling device in a closed position and viewing in the direction of the device.

Each possible embodiment disclosed in this text can be combined with the other possible embodiments disclosed in this text if there is no any technical constraint.

Other features which are considered as characteristic for the invention are set forth in the appended claims.

Although the invention is illustrated and described herein as embodied in a household appliance and a method of assembling housing parts of the household appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings. The figures, which are briefly explained herein, are solely intended for providing a better understanding of the present invention and are as such not intended to define the scope of protection or the context in which that scope is to be interpreted in the absence of the description.

DETAILED DESCRIPTION OF THE INVENTION

In this detailed description, the subject matter is explained with references to examples without forming any restrictive effect, only in order to make the subject more understandable.

Figure 1:
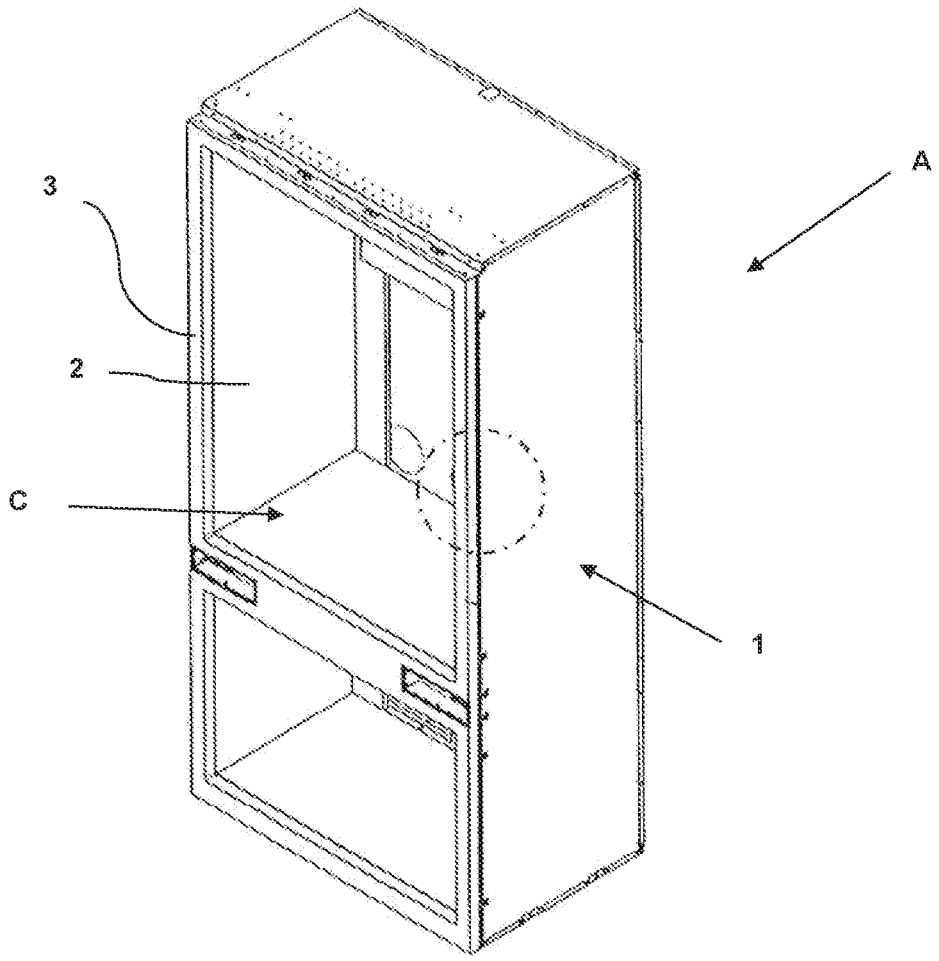
FIG. 1 is a diagrammatic, perspective view of the cooling device according to the invention.

Referring now to the figures of the drawings in detail and first, particularly, to FIG. 1 thereof, it is seen that the present invention relates to a cooling device having a non-illustrated storage chamber in a non-illustrated body of the cooling device. The storage chamber includes a compartment C which is defined by inner and outer liners 2, 1 and a non-illustrated rear panel. At least one non-illustrated door for opening and closing the storage chamber is disposed in front of the storage chamber. A housing frame 3 is provided for mounting the door. During the assembly of all of these housing parts to produce a household appliance A, additional support members are required which are an elastic member 4 and a reinforcement member 5, as can be seen from FIGS. 2-6.

Figure 2:
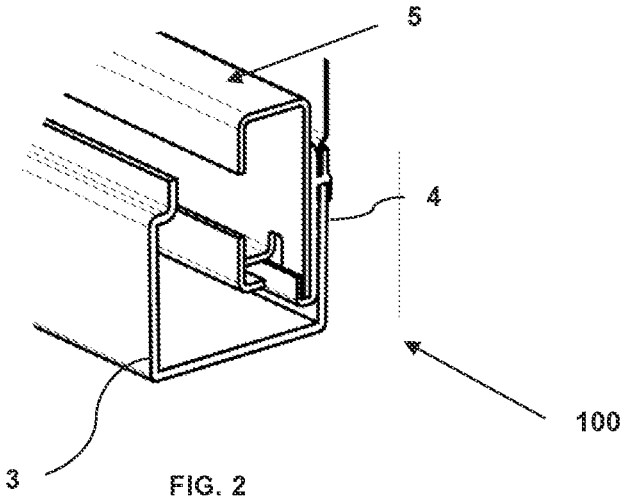
FIG. 2 is an enlarged, fragmentary, cross-sectional view of a region of a cooling device where the housing frame, reinforcement member and elastic member is provided.
Figure 4:
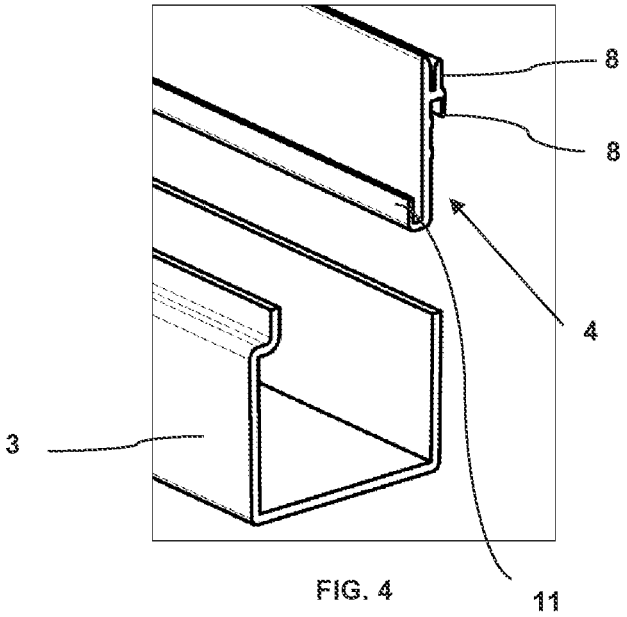
FIG. 4 is a further enlarged, fragmentary, cross-sectional view of a region of a cooling device where the elastic member is assembled to the housing frame.

With reference to FIGS. 2 and 4, it is seen that the elastic member 4 is firstly assembled to the housing frame 3. The elastic member 4 has at least two channels 8 facing in opposite directions relative to each other for being connected to the outer liner 1 from one side and to the housing frame 3 from the other side. Hence, the assembly of the outer liner 1 and the housing frame 3 is achieved by using the channels 8 provided on the elastic member 4. The elastic member 4 can be made from thermoplastic material, such as recycled polystyrene. This material increases the elasticity of the assembly part during the mounting process and also increases the durability of the household appliance A. The channel 8 also has a monolithic structure with the elastic member 4 and is produced by molding.

Figure 3:
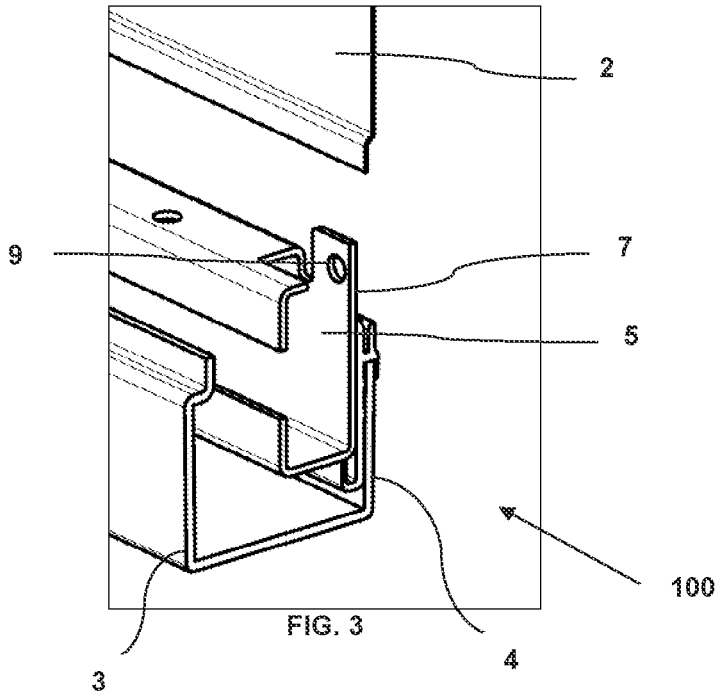
FIG. 3 is another enlarged, fragmentary, cross-sectional view of a region of a cooling device where the housing frame, inner liner, outer liner, reinforcement member and elastic member is provided.
Figure 5:
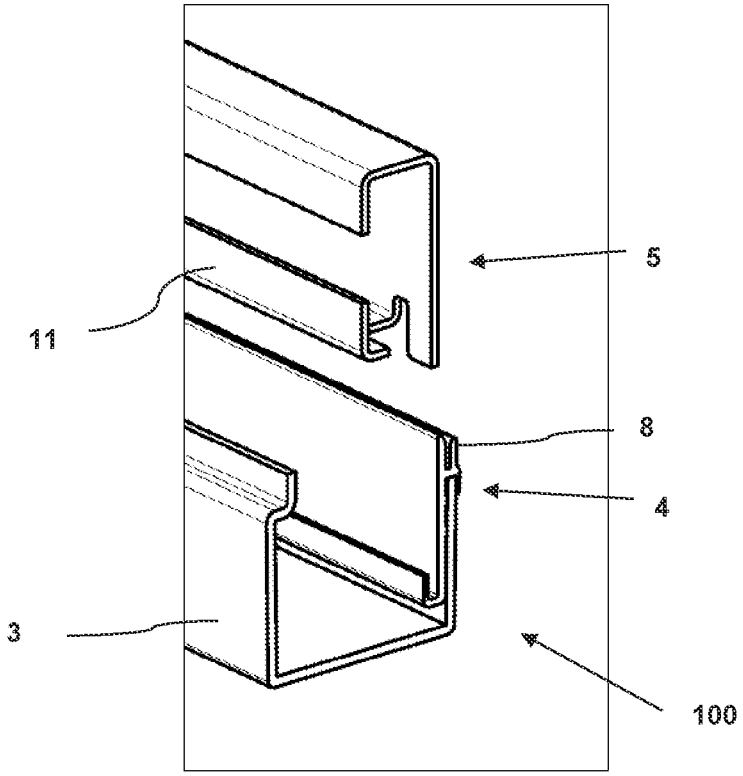
FIG. 5 is yet another enlarged, fragmentary, cross-sectional view of a region of a cooling device where the reinforcement member and the housing frame with elastic member is provided.
Figure 6:
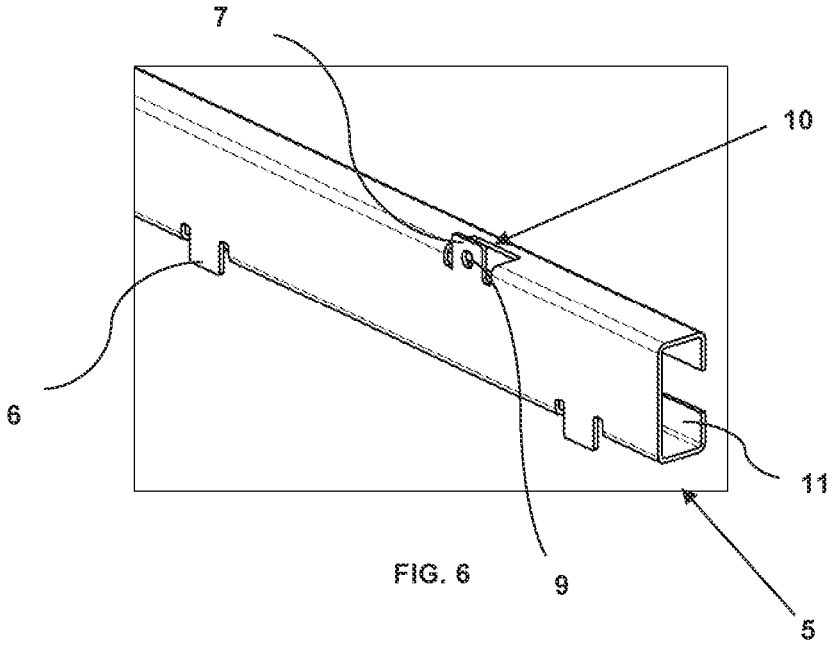
FIG. 6 is a perspective view of the reinforcement member.

Then, the reinforcement member 5 is combined with the elastic member 4, which can be seen from FIGS. 2, 3 and 5, preferably by shrink fitting. The reinforcement member 5 includes at least one first connection lug 6 and at least one second connection lug 7 provided thereon, as seen in FIG. 6. The first connection lug 6 extends from the reinforcement member 5 towards to the elastic member 4 and is significantly parallel to the outer liner 1 and the elastic member 4 in order to be combined with the channel 8 on the elastic member 4 in a loose manner. Similarly, the second connection lug 7, which has a connection hole 9 therein, also extends from the reinforcement member 5 towards to the outer liner 1 in an opposite direction to the first connection lug 6 and is significantly parallel to the outer liner 1 and the elastic member 4 for connecting with the outer liner 1. The reinforcement member 5 is made of a steel material, preferably a stainless steel material to increasing the rigidity of the appliance A. Additionally, the first and second connection lugs 6,7 have a monolithic structure with the reinforcement member 5 and are formed by cutting and bending the relative part of the reinforcement member 5.

For the purpose of further improving durability, it is proposed that the reinforcement member 5 has the connection holes 9 provided on the second connection lug 7. The connection holes 9 are provided on the reinforcement member 5 for assembling the outer liner 1 to the reinforcement member 5 by providing a rivet connection which can be applied from outside of the appliance A by operators.

With reference to FIGS. 5 and 6, it is seen that a bent part 11 extends from the reinforcement member 5. The bent part 11 creates extra space and is filled with insulation material to provide heat insulation for the household appliance A, especially for cooking devices.

As can be seen from FIG. 6, the reinforcement member 5 has at least one cutout 10 around each of the first and second connection lugs 6,7, which is produced by bending the lugs 6,7. These cutouts 10 provide space for insulation material to be filled in.

The following is a summary list of reference numerals and the corresponding structure used in the above description of the invention:

A Household appliance
C Compartment
100 Housing connection arrangement
1 Outer liner
2 Inner liner
3 Housing frame
4 Elastic member
5 Reinforcement member
6 First connection lug
7 Second connection lug
8 Channel
9 Connection hole
10 Cut out
11 Bent part

The invention claimed is:

1. A household appliance, comprising:
at least one compartment; and
a housing connection arrangement surrounding said at least one compartment, said housing connection arrangement including:
an outer liner facing outside the household appliance,
an inner liner spaced apart from said outer liner and facing said at least one compartment,
a housing frame having one side connected to said outer liner and another side connected to said inner liner,
a region having a connection of said housing frame to said outer liner,
at least one elastic member provided on said region of said housing connection arrangement, and
at least one reinforcement member provided adjacent to said outer liner, said housing frame and said elastic member,
said at least one reinforcement member including a first connection lug being at least partially received by a portion of said elastic member from one side, and a second connection lug having a connection member configured to be connected to said outer liner from another side; and
said elastic member having a receiving channel at least partially receiving said first connection lug in a loose manner.

2. The household appliance according to claim 1, wherein said connection member is a connection hole provided in said reinforcement member for combining said outer liner with said reinforcement member from outside of the household appliance.

3. The household appliance according to claim 1, wherein said elastic member is made from a thermoplastic material.

4. The household appliance according to claim 1, wherein said reinforcement member is made of a steel material.

5. The household appliance according to claim 1, wherein said channel has a monolithic structure with said elastic member.

6. The household appliance according to claim 1, which further comprises a bent part extending from said reinforcement member towards said housing frame for being filled with insulation material.

7. The household appliance according to claim 1, wherein said first and second connection lugs have a monolithic structure with said reinforcement member.

8. The household appliance according to claim 1, wherein said first and second connection lugs extend parallel to each other.

9. The household appliance according to claim 1, wherein said first and second connection lugs extend in mutually opposite directions.

10. The household appliance according to claim 1, wherein said reinforcement member is shrink-fitted to said elastic member.

11. The household appliance according to claim 1, wherein the household appliance is a cooling device or a refrigerator.

12. A household appliance, comprising:
at least one compartment; and
a housing connection arrangement surrounding said at least one compartment, said housing connection arrangement including:
an outer liner facing outside the household appliance,
an inner liner spaced apart from said outer liner and facing said at least one compartment,
a housing frame having one side connected to said outer liner and another side connected to said inner liner,
a region having a connection of said housing frame to said outer liner,
at least one elastic member provided on said region of said housing connection arrangement, and at least one reinforcement member provided adjacent to said outer liner, said housing frame and said elastic member, said reinforcement member having at least one cutout providing a free area for insulation material to be filled in, said at least one reinforcement member including a first connection lug being at least partially received by a portion of said elastic member from one side, and a second connection lug having a connection member configured to be connected to said outer liner from another side.

13. A household appliance, comprising:

at least one compartment; and a housing connection arrangement surrounding said at least one compartment, said housing connection arrangement including:

an outer liner facing outside the household appliance, an inner liner spaced apart from said outer liner and facing said at least one compartment, a housing frame having one side connected to said outer liner and another side connected to said inner liner, a region having a connection of said housing frame to said outer liner, at least one elastic member provided on said region of said housing connection arrangement, and at least one reinforcement member provided adjacent to said outer liner, said housing frame and said elastic member, said at least one reinforcement member including a first connection lug being at least partially received by a portion of said elastic member from one side, and a second connection lug having a connection member configured to be connected to said outer liner from another side, said connection member of said second connection lug being a connection hole for assembling the household appliance.

* * * * *